US011806604B2

(12) United States Patent
Plizga

(10) Patent No.: US 11,806,604 B2
(45) Date of Patent: Nov. 7, 2023

(54) ICE SKATING AID

(71) Applicant: Craig J Plizga, Glenwood Springs, CO (US)

(72) Inventor: Craig J Plizga, Glenwood Springs, CO (US)

( * ) Notice: Subject to any disclaimer, the term of this patent is extended or adjusted under 35 U.S.C. 154(b) by 98 days.

(21) Appl. No.: 17/400,399

(22) Filed: Aug. 12, 2021

(65) Prior Publication Data

US 2021/0370156 A1 Dec. 2, 2021

Related U.S. Application Data

(63) Continuation-in-part of application No. 16/895,512, filed on Jun. 8, 2020, now Pat. No. 11,517,801.

(60) Provisional application No. 62/857,894, filed on Jun. 6, 2019.

(51) Int. Cl.
*A63C 3/04* (2006.01)
*A63B 69/00* (2006.01)

(52) U.S. Cl.
CPC ..... *A63C 3/04* (2013.01); *A63B 69/0022* (2013.01)

(58) Field of Classification Search
CPC ..... A63C 3/04; A63B 69/0022
See application file for complete search history.

(56) References Cited

U.S. PATENT DOCUMENTS

| | | | | |
|---|---|---|---|---|
| 2,608,409 | A | 9/1949 | Pinkerton | |
| 2,774,600 | A * | 12/1956 | Reach | A63B 53/04 473/328 |
| 3,834,697 | A | 9/1974 | McNamara | |
| 5,127,649 | A | 7/1992 | Carbonero | |
| 5,294,127 | A * | 3/1994 | Keelan | A63B 69/3638 473/226 |
| 5,672,120 | A * | 9/1997 | Ramirez | A63B 53/047 473/347 |
| 6,227,982 | B1 * | 5/2001 | Wurster | A63B 69/3614 473/220 |
| 9,101,806 | B1 * | 8/2015 | Aguinaldo | A63B 53/02 |
| 2004/0097306 | A1 | 5/2004 | Dehen | |
| 2008/0113824 | A1 * | 5/2008 | Pamias | A63B 53/14 473/246 |
| 2013/0130830 | A1 * | 5/2013 | Boyd | A63B 53/0466 29/527.1 |
| 2019/0143187 | A1 * | 5/2019 | Lyons | A63B 60/08 15/144.3 |

* cited by examiner

*Primary Examiner* — Eugene L Kim
*Assistant Examiner* — Christopher Glenn
(74) *Attorney, Agent, or Firm* — Leyendecker & Lemire LLC

(57) ABSTRACT

A skating aid comprising novelty figure, such as a snowman, from which a stick or handle, similar to the handle of the hockey stick, protrudes is described. The base of the novelty figure typically has two flat sections proximate its bottom angled relative to each other with the first flat section defining a storage position of the aid when it is not in use, and the second flat section defining a skating position for the aid when in use.

5 Claims, 23 Drawing Sheets

ICE SKATING AID

RELATED APPLICATIONS

The application is a Continuation in Part of U.S. Non-Provisional Patent Application Ser. No. 16/895,512 entitled Hockey Stick Blade Cover filed on 8 Jun. 2020 and having the same inventor as the present application. Application Ser. No. 16/895,512 claimed priority to U.S. Provisional Patent Application No. 62/857,894 entitled Puck Blade filed on 6 Jun. 2019. Both prior applications are incorporated herein by reference.

BACKGROUND

Learning to skate can be difficult let alone learning how to skate properly with good form. Unfortunately, about the only skating aids allowed or available for use on a rink during a public skate are skating trainers, devices shaped like support walkers. While these devices can help support a novice skater and reduce the risk of him/her falling down, they are not particularly fun to use and very good at helping the skater learn to skate properly. Essentially, they put a user in an upright stance with his/her legs straight directly underneath his/her torso; whereas in contrast, proper skating techniques requires a skater's knees to be bent and to take strides.

DETAILED DESCRIPTION

Figure 1:
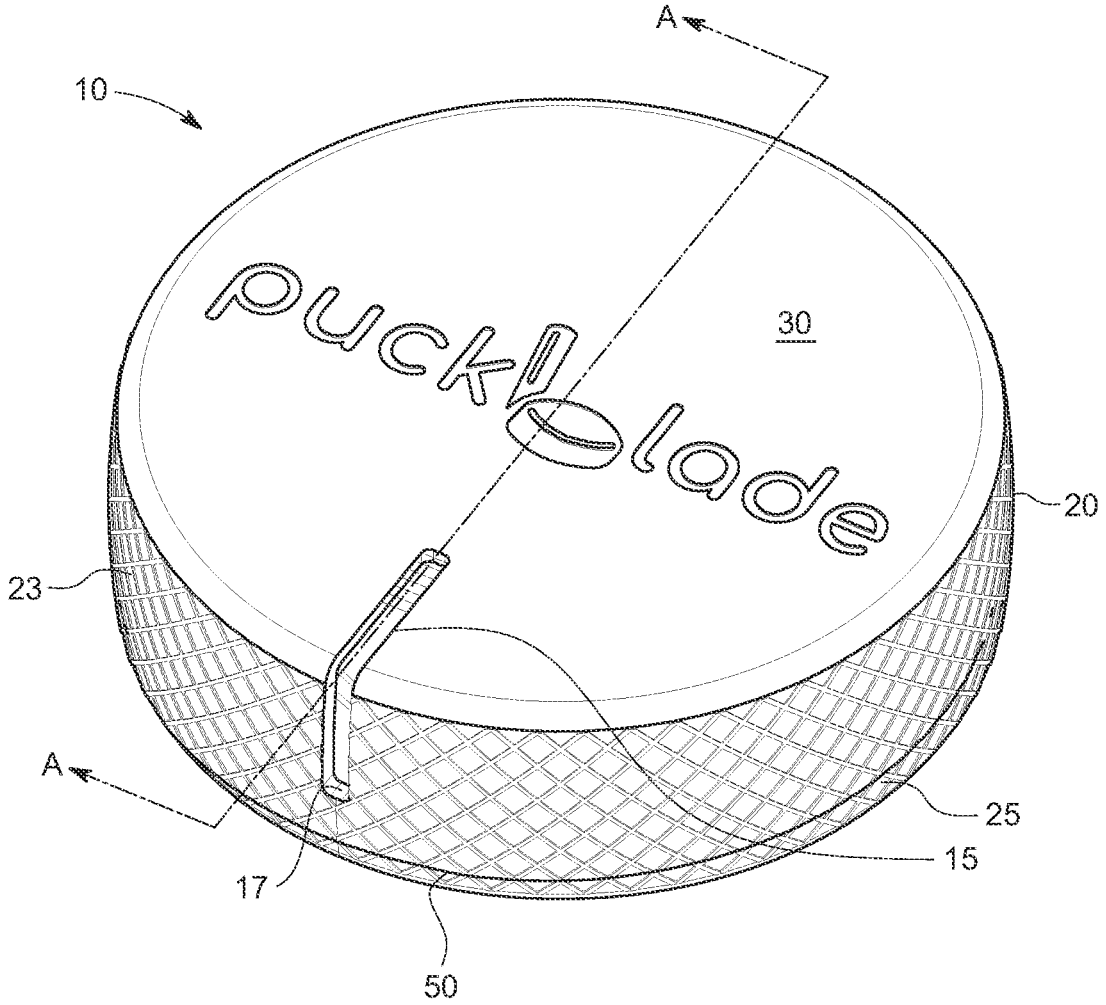
FIG. 1 is a perspective top view of the blade cover according to one embodiment of the present invention.
Figure 2:
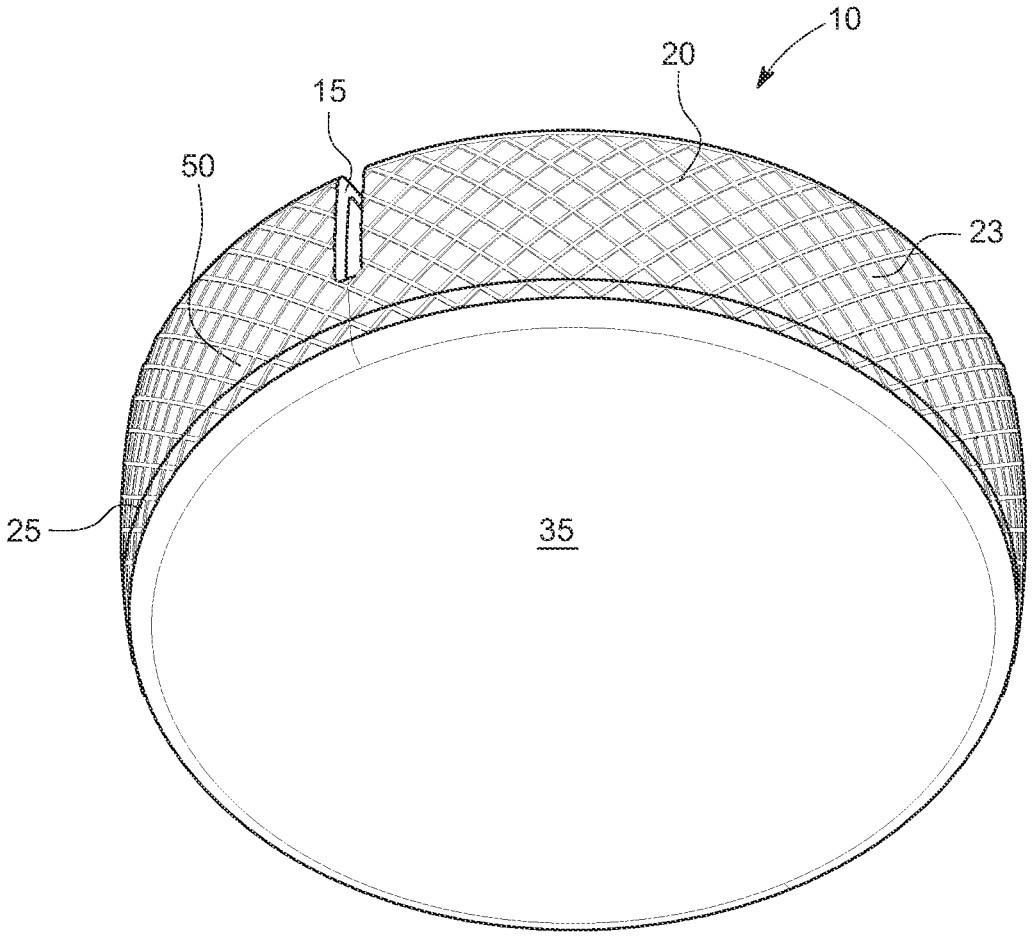
FIG. 2 is a perspective bottom view of the blade cover according to the embodiment of the present invention.

Hockey players routinely and instinctively use their sticks as skate-aids. Hockey Sticks permits them to both skate freely and they provide a bit of support when needed. In this regard hockey sticks are akin to canes. In contrast, prior art skate aids are akin to walkers: it is there to be used only when the skater loses or begins to lose his/her balance. The amount of support offered by a hockey stick is relatively small but a small amount of potential extra support can often make the difference between falling and remaining upright.

First, second and third embodiments of the present invention comprise a disk-shaped cover for a blade of a hockey stick wherein the cover is relatively weighty and includes a substantially flat bottom surface that is designed to lay flat against the surface of ice. The cover is designed to be used in concert with a hockey stick as an enhanced balancing aid over a hockey stick by itself to be used by a new or novice skater. It further helps teach the novice skater how to hold a hockey stick while skating.

The first, second and third embodiments of the cover, some of which can be shaped like and resemble an oversized hockey puck, are typically made of a semi-hard to hard elastomeric material, such as polyurethane or a synthetic rubber. In the illustrated embodiment the cover is injection molded as two pieces that are bonded together. Opposing ridges, nubbins and/or constraining walls are provided on the downwardly and upwardly facing interior surfaces to help frictionally hold and secure the blade of the hockey stick therein.

Fourth embodiments of the present invention comprise a body in the shape of a novelty figure, such as a snowman, from which a stick or handle, similar to the handle of the hockey stick, protrudes at a predetermined angle. The base of the body typically has two flat bottom sections that are angled relative to each other with the first flat bottom section being substantially flat and defining a skating position for when in the aid is in use and the second flat bottom defining a storage position of the aid for storing the unit when it is not in use.

In the storage position the handle, which is secured to and protrudes from the back of the figure is pointed primarily upwardly canted slightly forward, about 5-10 degrees. In this position the aid is very stable and can be stored without inordinate concern that the aid will fall over. Further, by positioning the stick as indicated various aids can be more compactly stored next to each other.

In the skating position, the entire figure is canted rearwardly until the first flat bottom section is received flatly or mostly flatly on the ice. In this position the handle generally makes an angle with the horizontal ice of about 40-50 degrees. Like the other embodiments, the aid in this position helps balance a new skater and helps him or her stay upright.

As mentioned, the first flat bottom section is substantially flat but can have a slight curvature depending on the particular variation.

The novelty figure body is typically comprised primarily or substantially of a foam material that is relatively forgiving if the user or another person on the rink falls into it. In some variations, the entire body is made of foam and the handle is received and secured into the foam. In another version, the body comprises (i) a base or lower portion having the two flat bottom sections and a receiving sleeve for the handle, and (ii) a lightweight foam upper portion in the form of the novelty figure. The upper portion is secured to the base portion. This construction permits a variety of different novelty figures to be fitted to the same base portion. In at least one other variation with a base the upper portion can comprise a thin walled hollow structure, such a blow molded figure, instead of being comprised of foam.

Fifth embodiments of the present invention comprise a puck-shaped base generally similar in size and shape to the puck-shaped first, second and third embodiments that is also typically comprised of a semi-rigid elastomer, except it includes an at least partially flexible sleeve that extends from the center thereof in which a handle can be received. When not in use the sleeve supports the handle in a generally vertical stance. To use the aid, a skater merely pulls and lowers the end of the stick towards himself or herself, and uses the aid in substantially the same manner as the first, second and third embodiments in combination with a hockey stick.

Sixth embodiments of the present invention comprise a puck-shaped base very similar in size and shape to the first, second and third embodiment pucks except a top portion of the base is preferably fabricated from a foam and more preferably from a self-skinning foam, similar to polyurethane foam used to fabricate Nerf™ footballs and other Nerf™ products. It includes a furcated slot into which the blade's of various curves can be inserted. The friction from the skin against the blade can help hold and secure the blade within the slot.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

As used herein, the term "nubbin" refers to a discreet protrusion that extends from an associated surface. Nubbins are typically cylindrical and relatively squat in height but as used herein the general cross sectional shape of a nubbin can vary and include, but is not limited to, circular, ovular, rectangular, and triangular. While the nubbins depicted in the figures are relatively squat in height, it is appreciated they can be longer in variations. As used herein unless otherwise specified the term "nubbin" is synonymous with the term "post", A "squat nubbin" is a nubbin where in the height of the nubbin compared to its diameter or width is no greater than 1.5 times, and more preferably about 1.0 times.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

A First Embodiment Skating Aid Comprising a Hockey Stick Blade Cover

FIGS. 1-9 illustrate embodiments of a hockey stick cover 10 according to the present invention. Essentially, the cover comprises a disk having an annular vertical side 23 spanning between a bottom perimeter of a bottom side 35 and a top perimeter of a top side 30 to define a hollow interior 27. At least the bottom surface of the bottom side being substantially flat. The overall height of the cover is typically about three inches, although the height is dictated by the height of the blade 105 of a hockey stick 100 it is configured to be received in the hollow interior. The thicknesses of the various sides can vary depending on several factors including the material from which the cover is made, the desired weight of the cover, and the cost and amount of material used to produce the cover. In at least one variation, the side walls are about 0.19" thick.

A slot 15 is provided extending vertically upwardly along a portion of the vertical side 23 beginning at a bottom end (or slot lip 17) located a predetermined distance above the bottom side 35 depending on the size of a hockey stick blade to be received therein, and extending radially inwardly along the top side 30 to a slot inside end for a predetermined length (typically about three inches). The slot is typically about 0.3" wide to accommodate the blade 105 of a hockey stick 100, although this can vary depending on the width of the blade intended to be received in the cover.

The cover 10 can be made of any suitable material and by any suitable manufacturing process; however, the illustrated embodiment comprises two separate pieces 20&25 that are subsequently joined, such as by adhesive bonding to create a one piece cover. The top piece of the illustrated embodiment includes the top side 30 and a substantially all of the annular side 23. The bottom piece primarily comprises the bottom side 35. Typically, both the top piece 20 and bottom piece 25 are molded, such as injection molded, from a semi-hard to hard elastomeric material; an adhesive is typically applied to a groove or lip formed in one or both the bottom and top pieces; and the top piece is placed on to the bottom piece securing them together at a seam 50 once the adhesive has cured. In one variation the elastomeric material has a Shore A hardness of about 80, although materials that are either softer or harder than 80 can also be utilized.

As best shown in FIGS. 3-6 the interior 27 of the cover 10 is substantially hollow. FIGS. 4A,B&C show three variations of the interior surface of the top side 30. FIGS. 5A,B&C show two variations of the interior surface of the bottom side 35. As is evident in each of the figures, the interior surfaces are substantially flat except for either downwardly or upwardly extending protrusions 40,45,55, 60,75&80. These protrusions are integrally molded into the cover and, as such, comprise the same resilient material as the remainder of the cover. They act to help hold the blade of a hockey stick therein as shown in FIGS. 6A,B&C and described below.

Figure 4A:
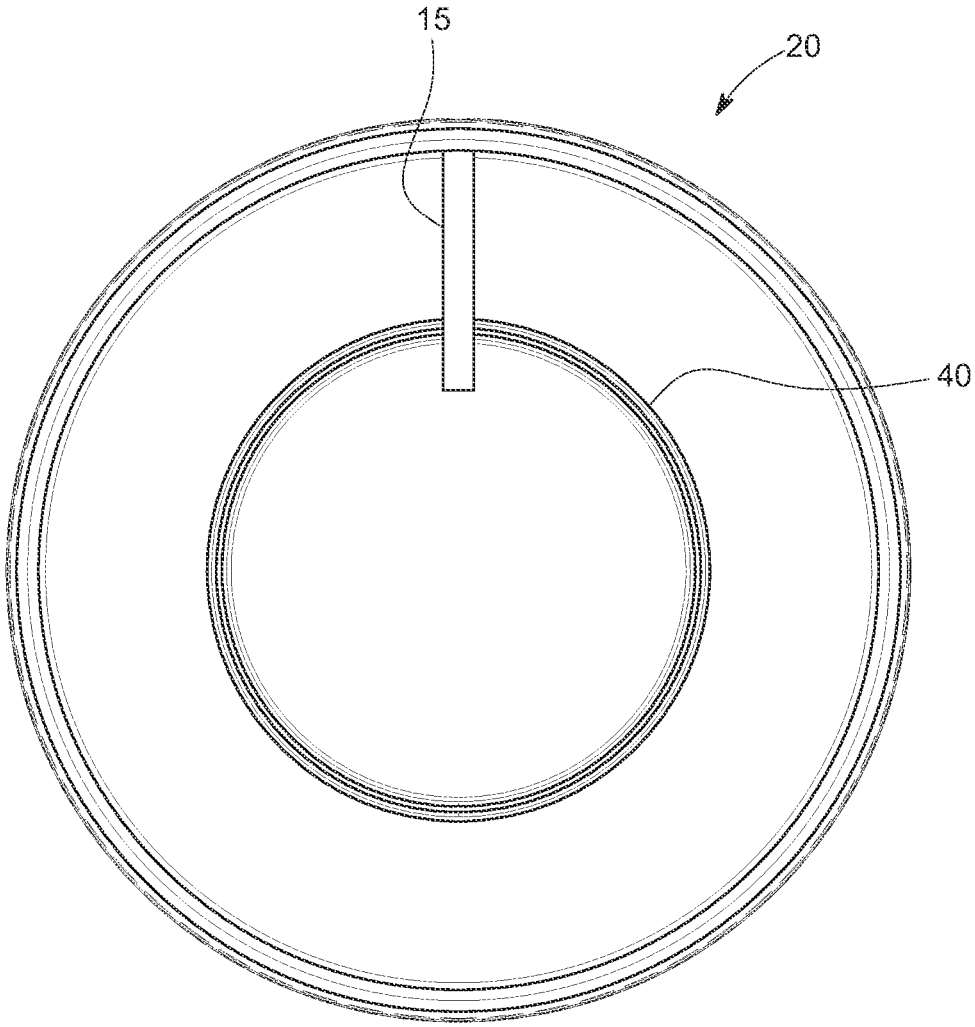
FIG. 4*a,b*&*c* are upwardly looking views of the bottoms of three embodiments of the top piece of the blade cover.
Figure 4B:
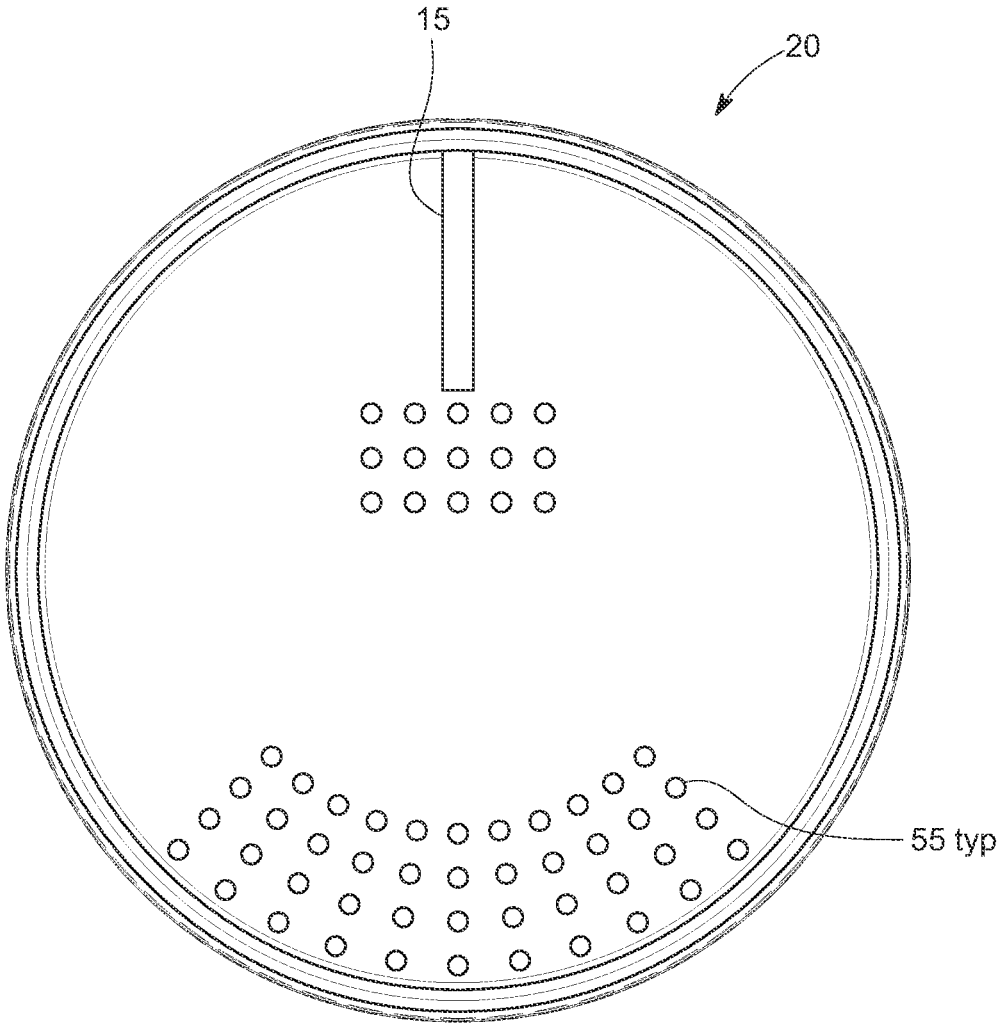
Figure 5A:
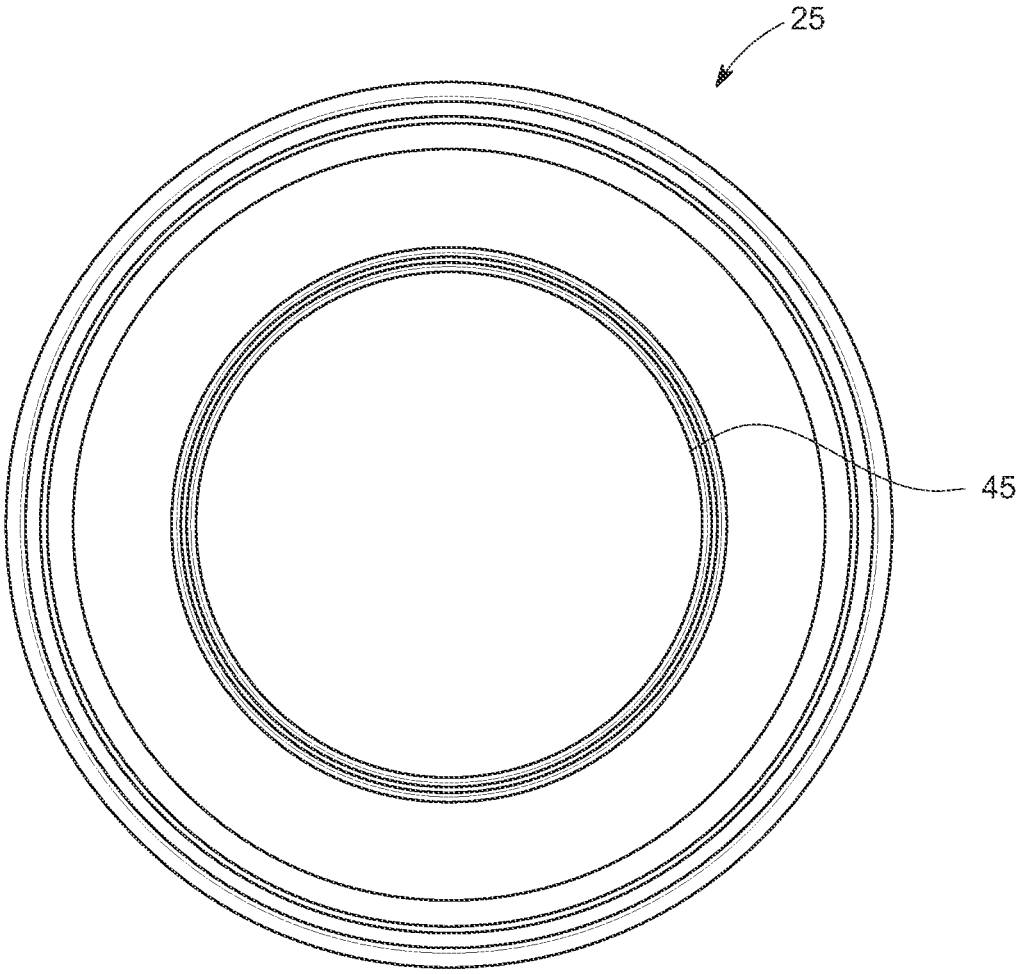
FIGS. 5*a,b*&*c* downwardly looking views of the tops of three embodiments of the bottom piece of the blade cover.
Figure 5B:
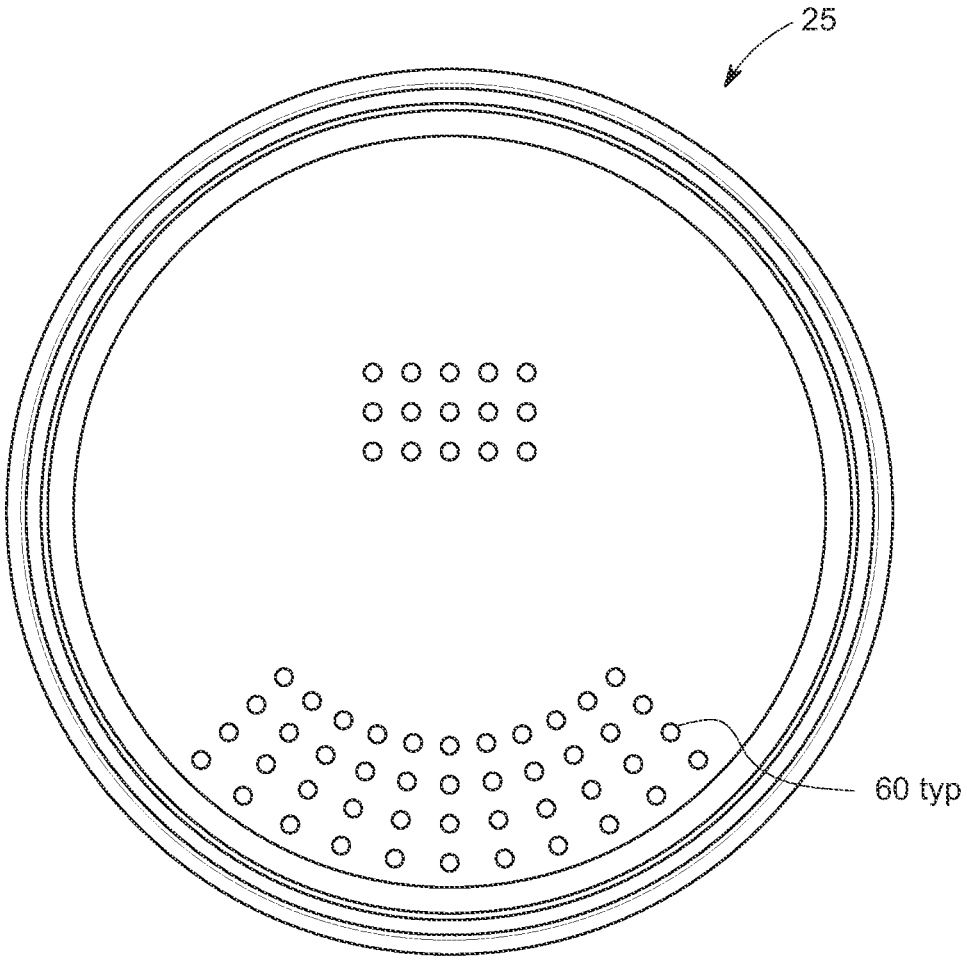
Figure 5C:
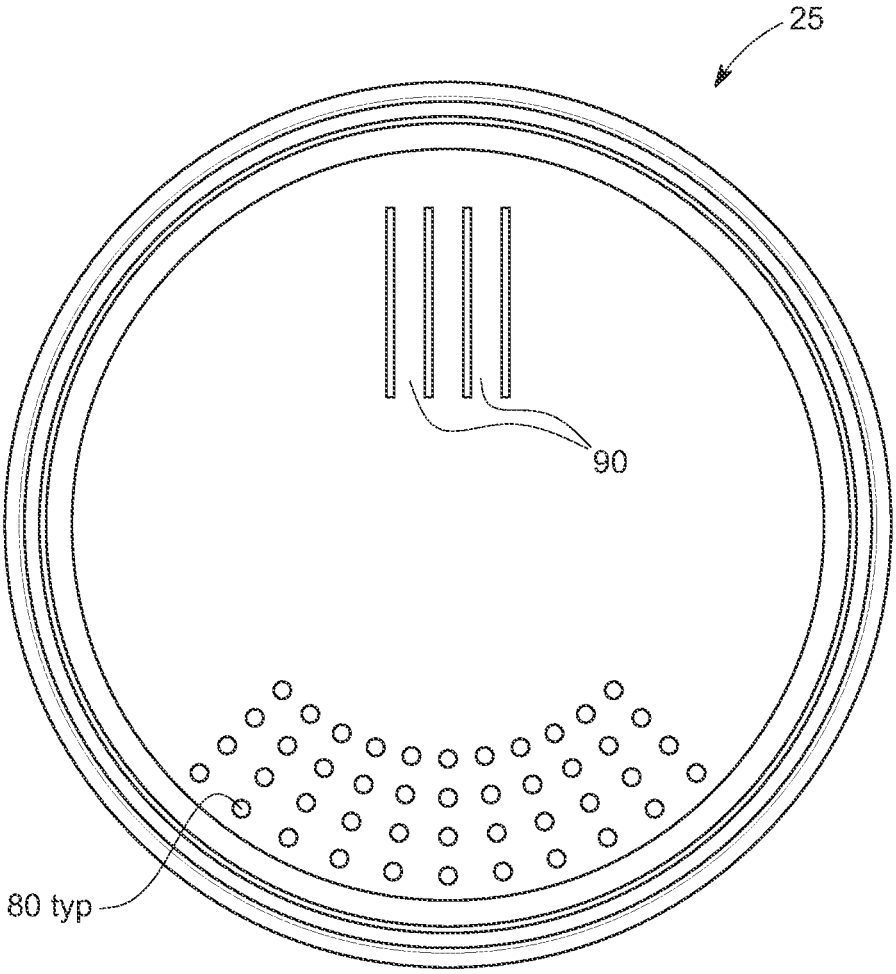

In the cover variations shown in FIGS. 4A&5A the protrusions comprise downwardly-extending and upwardly extending annular ridges 40&45 that are spaced from and centered about the center point of the top and bottom side interior surfaces respectively. The ridges are generally triangular in cross section and extend about 0.25" from the associated surface in one variation.

In FIGS. 4A&5A the protrusions comprise downwardly-extending and upwardly extending nubbins 55&60 arranged in several arrays. A first upper array is adjacent to and located radially inward of the inner end of the slot 15 on the interior surface of the top side. The first lower array is located directly below the first upper array on the interior surface of the bottom side. An arcuately-configured second upper array is spaced from the first upper array on an opposite side of the center point of the interior surface generally adjacent to the top perimeter. An arcuately-configured second lower array is typically located directly below the second upper array. In one variation the nubbins are about 0.13" in diameter and about 0.25" tall although the dimensions can vary significantly in other variations.

Figure 3A:
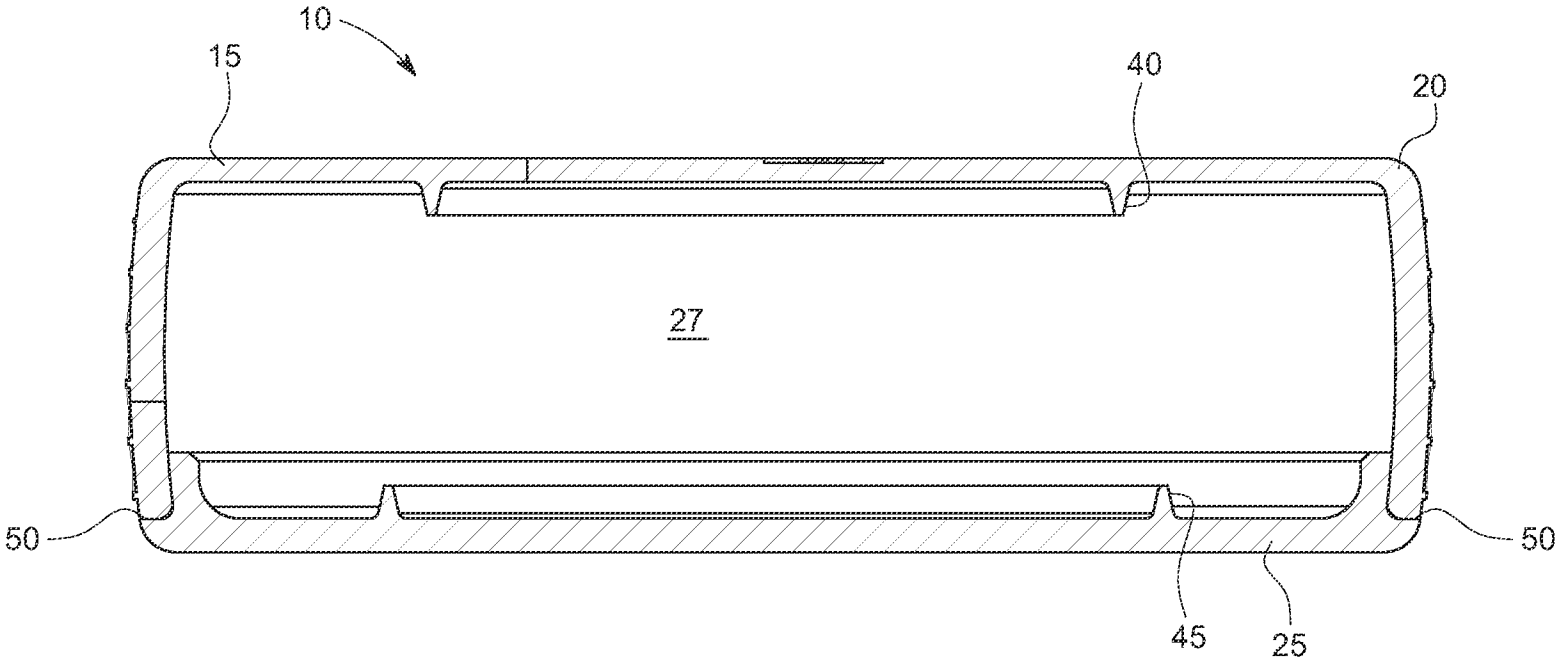
FIG. 3*a*&*b* are cross section side views of the blade cover taken along line A-A of FIG. 1 according to two embodiments of the present invention.
Figure 3B:
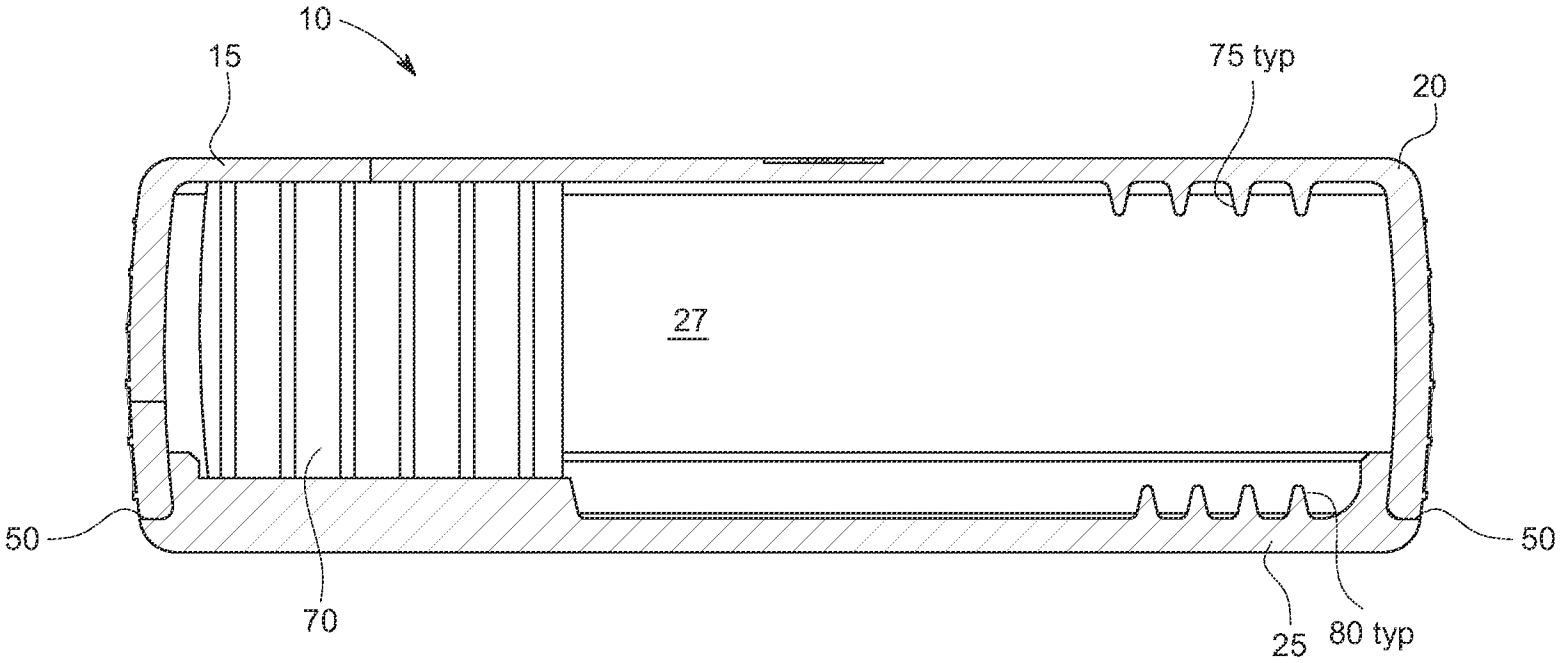
Figure 8:
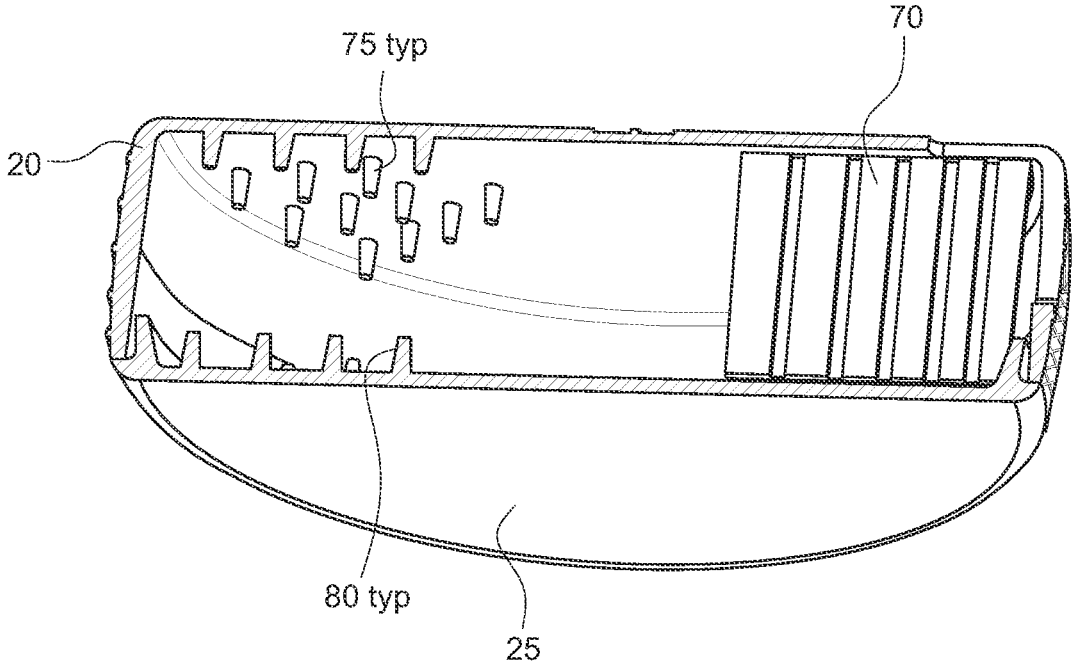
FIG. 8 is a perspective cross sectional view of an embodiment of the present invention.
Figure 9:
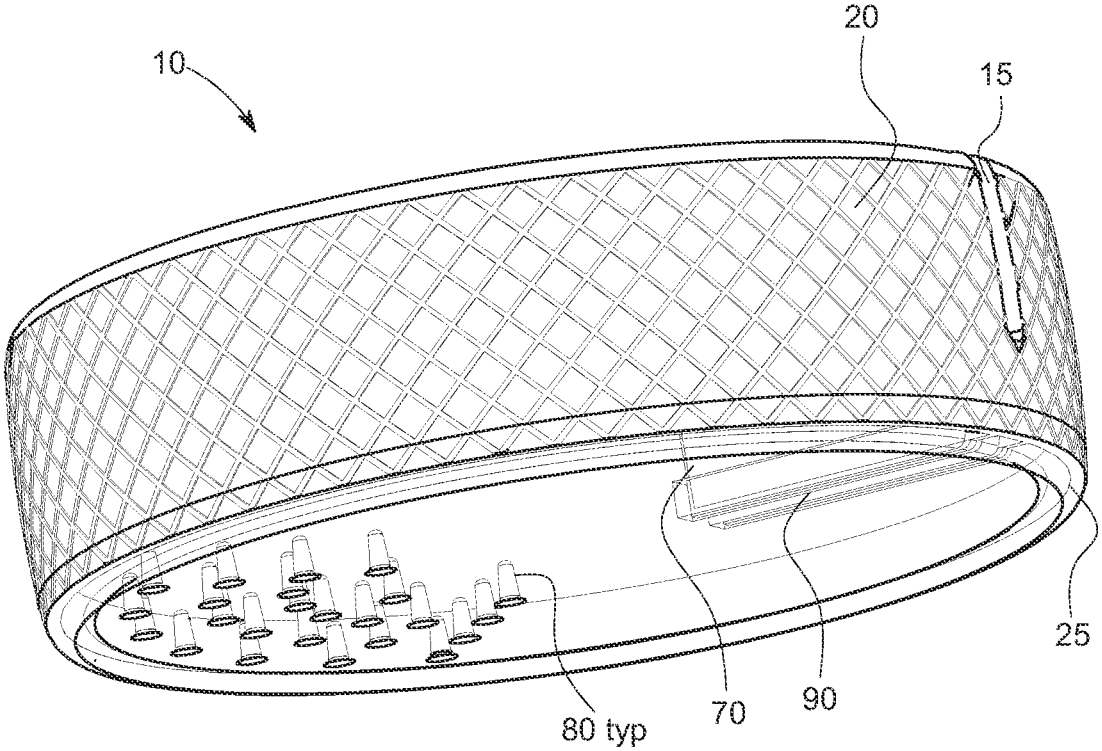
FIG. 9 is a perspective bottom side view of the same embodiment but wherein the bottom is shown as translucent to reveal the internal structure thereof.

In 4C&5C, the protrusions comprise a combination of left and right walls 70 that bound the slot 15, and upwardly and downwardly extending arrays of nubbins 75&80. This embodiment is also illustrated in FIG. 3B. The walls 70 are typically molded into the top side of the top piece and extend downwardly the entire distance height of the interior 27. The walls may be textured to help grip the sides of the hockey stick blade 105. As shown in FIGS. 3B&8, the wall surfaces comprise a series of parallel grooves. Further on the interior surface of the bottom pieces corresponding wall-receiving slits 90 are provided in which to receive the ends of the left and right walls when the top and bottom pieces are joined together with each slit being defined by a pair of parallel squat upwardly extending linear protrusions.

Figure 4C:
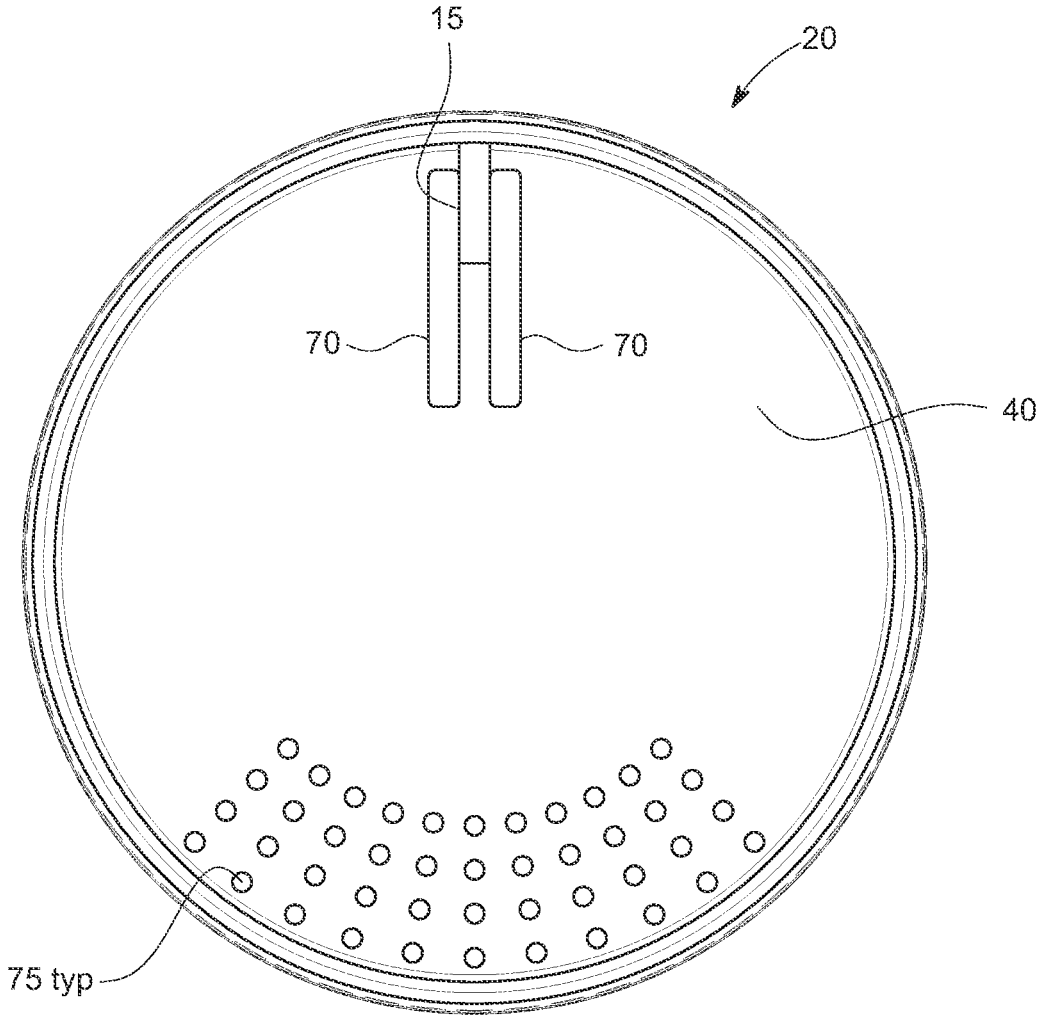

As also can be seen in FIGS. 4C&8, the length of the radially-extending portion of the slot 15 along the top side is shorter than on the other illustrated variations extending about 1.5 inches. As can be appreciated the length of the slot along the top side can vary in all of the variations such that the shorter length slot can be utilized in the other variations as well. The arrays of nubbins 75&80 in this variation are similar to the second upper and lower arrays described above relative to the embodiment of FIG. 4B in configuration and positioning.

Figure 6A:
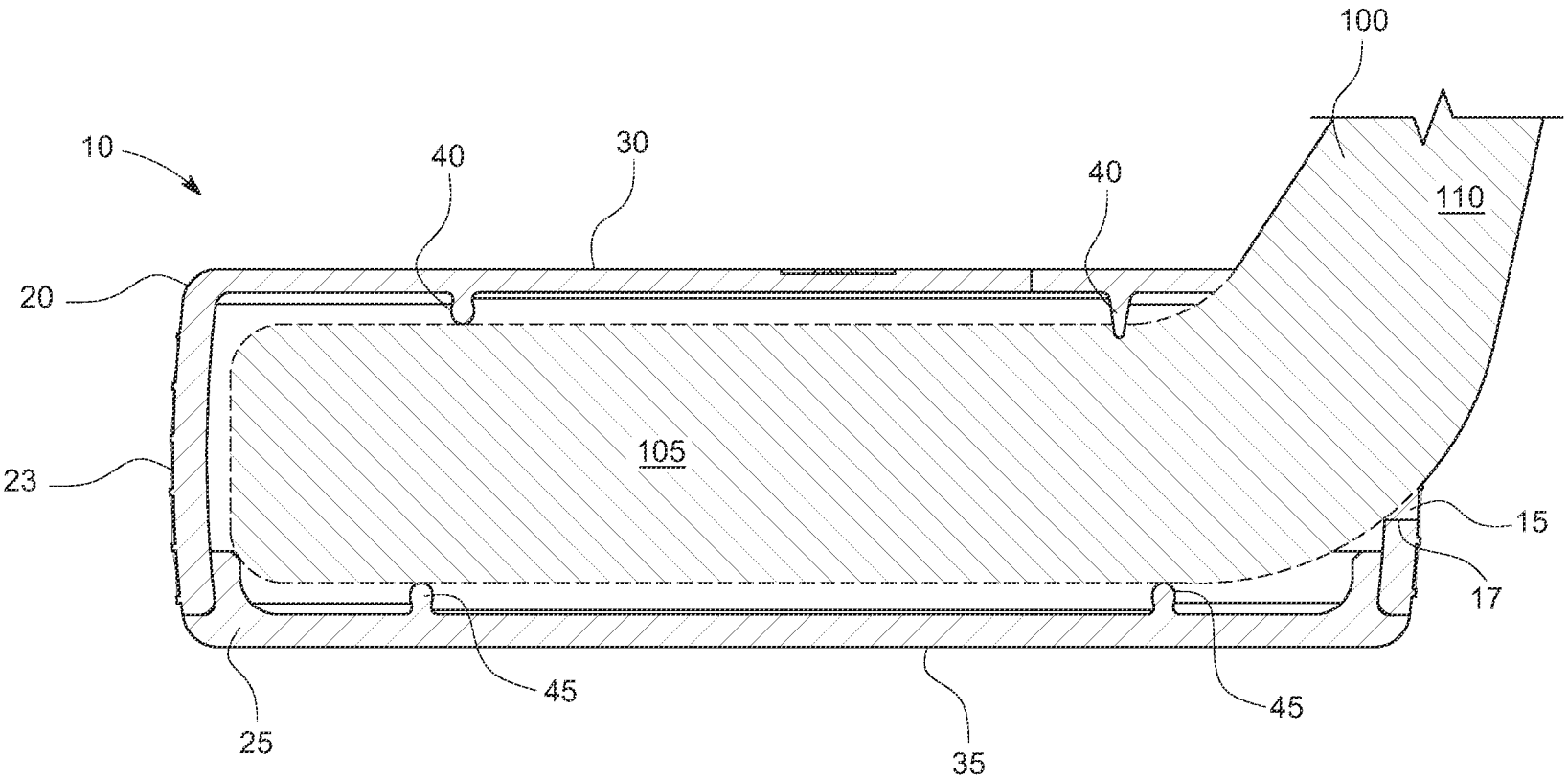
FIGS. 6*a,b*&*c* are cross sectional views of the cover with the blade of a hockey stick inserted therein according to three embodiments of the present invention.

FIGS. 6A&B&C and 7 illustrate the blade 105 of a hockey stick 100 substantially and removably received in the cover 10. When the blade is received in the cover and the cover's bottom side 35 is resting on a flat surface, such as that of an ice rink, the handle (or shaft) 110 of the hockey stick extends both upwardly and outwardly of the cover. The back edge of the blade intersects with and rests against the slot lip 17 of the slot 15 acting to hold the shaft in an upright manner. In use, a novice skater holds the handle with one or both hands while skating. In this manner, the cover and stick combination act to help stabilize the skater reducing his/her risk of falling while also promoting proper skating technique.

In some variations, the weight of the cover 10 may be sufficient so that stick 100 and cover combination remains upright and does not fall over when the handle 110 of the stick is released despite the fact that the handle may be angled outwardly of the cover as shown. As necessary, additional weight can be achieved by making one or more pieces thicker or adding one or more weights, typically made of steel or another heavy metal, that can be secured in the interior or even molded into the cover. In some variations, the cover weighs about two pounds and this has been found to be sufficient to hold a hockey stick upright; however, the actual weight required will depend on the diameter (or foot print) of the cover, the size and weight of the stick and the angle at which the handle projects outwardly from the cover.

Figure 6B:
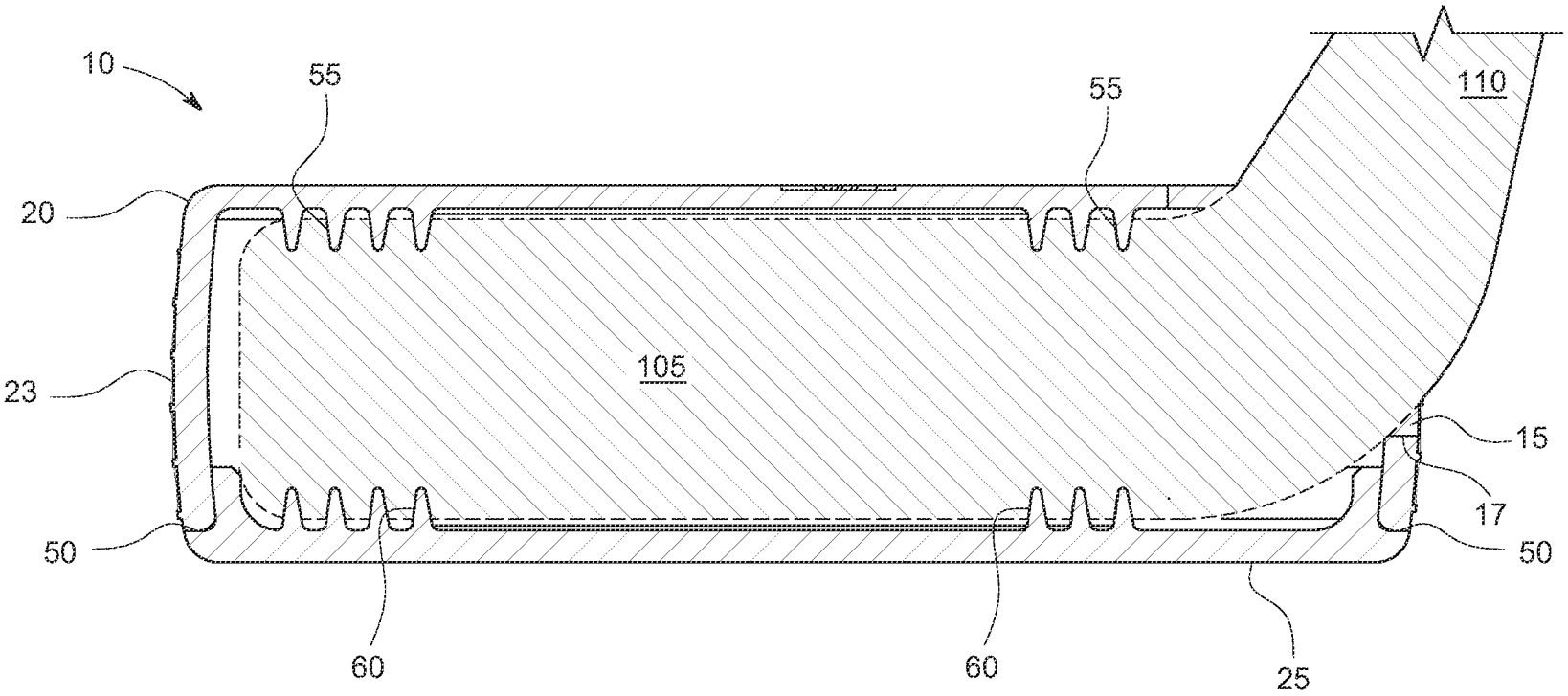
Figure 6C:
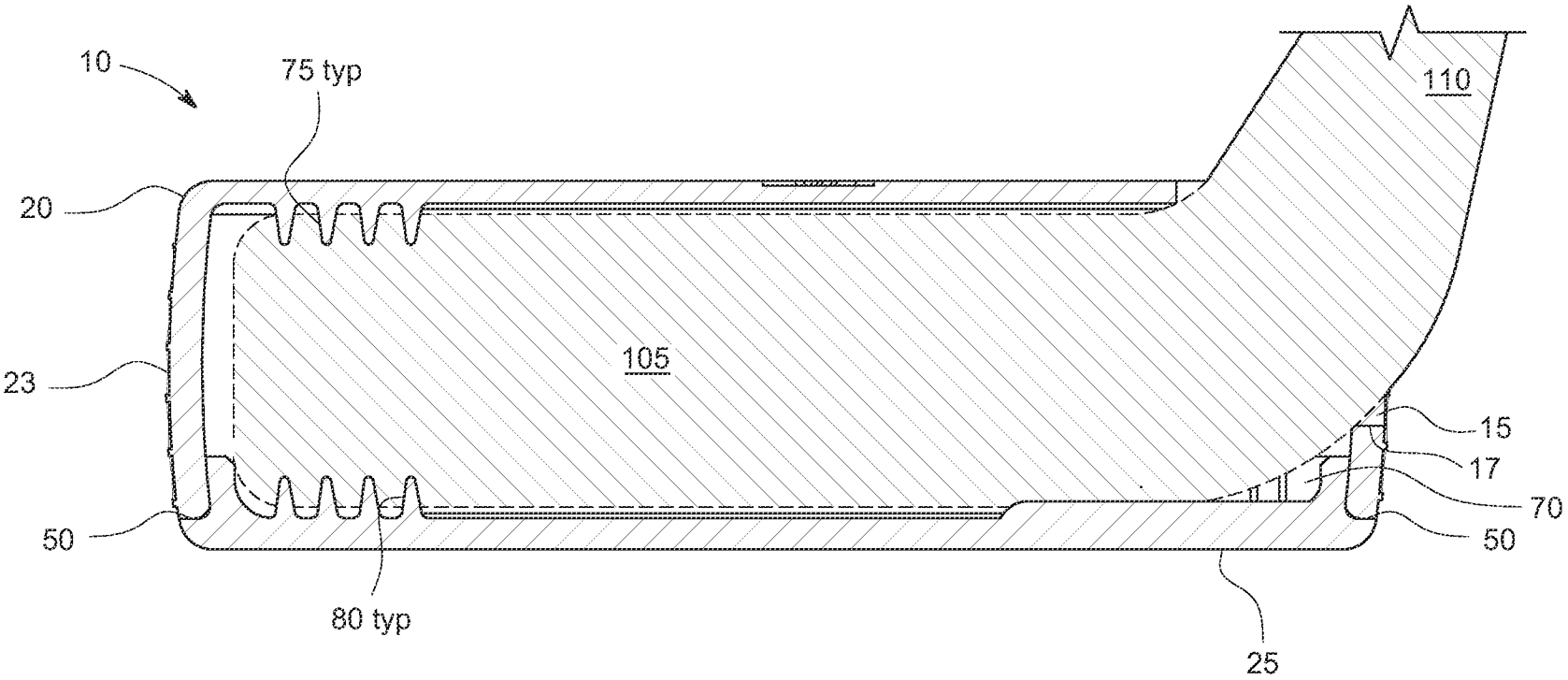
Figure 7:
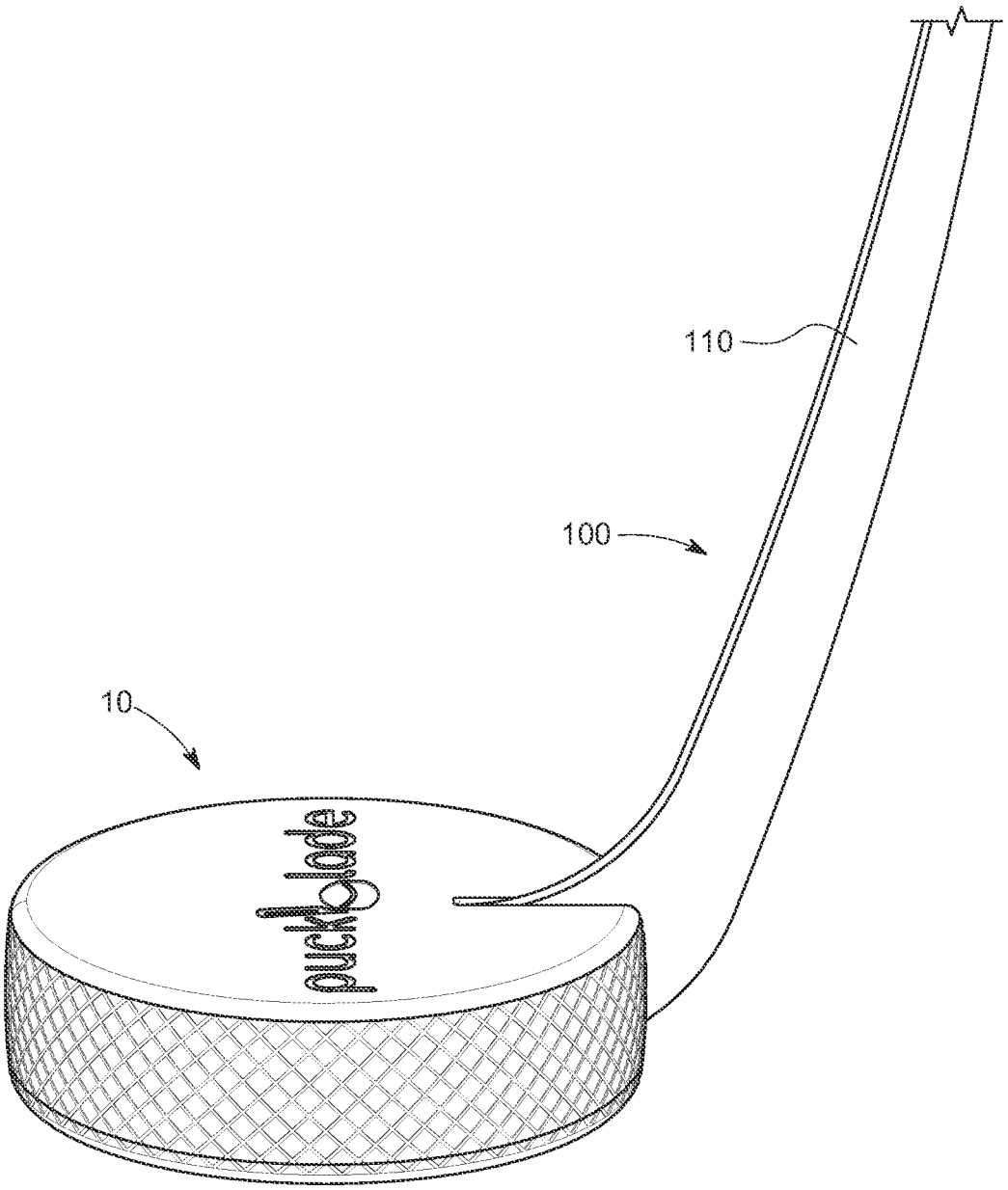
FIG. 7 is a perspective view of the cover with a hickey stick inserted therein according to an embodiment of the present invention.

FIGS. 6A&B&C are cross sectional views of the interior of the cover 10 but with the blade 105 of a hockey stick 100 securely received therein. As can be seen most of the blade is contained within the hollow interior 27 of the cover with the front edge touching or almost touching the interior surface of the vertical annular side 23. A small portion of the blade, essentially where it begins to taper, may extend outside of the slot. The edges of the blade at this location interface with the left and right edges of the slot 15 to help hold the blade and stick in place. With reference to FIG. 6A, the ridges 40 & 45 may flex and compress to frictionally engage the top and bottom edges of the blade to further secure it in place. Further, the portions of the top ridge 40 bounding the edges of the slot may extend downwardly past the top edge of the blade to help hold it in place. With reference to FIG. 6B, the top and bottom edges of the blade above and below the nubbin arrays settle between nubbins 55&60, which also act to effectively secure the blade in place. With reference to FIG. 6C, the blade is sandwiched between left and right walls 70 proximate the slot 15 and where the wall extends forwardly therefrom. Proximate the distal end of the blade, the top and bottom edges thereof are received in between the upper and lower arrays of nubbins 75&80.

To install a hockey stick 100 in the cover 10, the front of the blade 105 is pushed into the interior of the cover by way of the slot 15. Typically, the blade is initially angled downwardly and pivoted towards horizontal as it is advanced into the interior towards the side of the vertical sidewall opposing the slot opening. As the blade is passed through and across the opposing ridges 40&45, through the opposing arrays of nubbins 55&60, or between the walls 70, the force necessary to slide the blade fully into the interior may increase. The cover can be placed against a wall or even in the corner of a wall to brace it and hold it in place while the stick is pushed further into the cover.

In use, a skater places the bottom side 35 of the cover 10 against the surface of an ice rink while holding the handle 110 in at least one hand. The novice skater then skates around the rink. While not providing the level of support of a traditional skating trainer, the combination does provide for enhanced balance and for balance recovery should the skater begin to lose balance. Further, unlike the skating trainer, the stick and cover combination encourages a skater to assume a proper skating stance with his/her legs bent and leaning slightly forward. The trainer can also be used by more experienced skaters who want to get ice time in to hone or improve their skills but must do so on a public rink during a public skate where uncovered sticks may be prohibited.

A Fourth Embodiment Skating Aid Comprising a Novelty Figure with an Extended Handle The fourth embodiment skating aid 200 is illustrated in FIGS. 10-13 and in its most basic comprises a body 205 with one or more flat or substantially flat bottoms 215 & 220 and an elongated handle 210 that extends upwardly from the body wherein the handle is secured.

Figure 10:
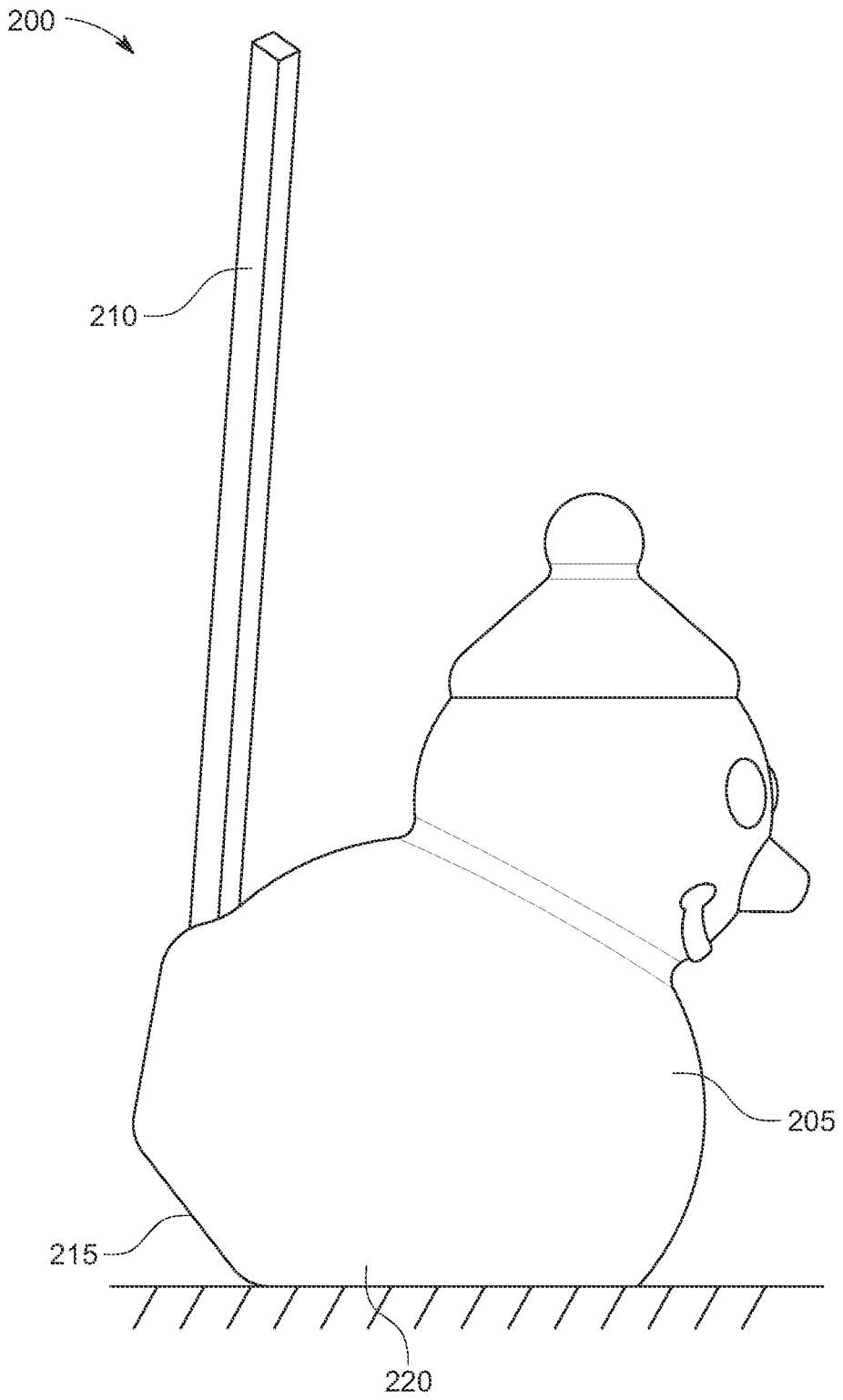
FIG. 10 is a perspective view of a fourth embodiment of a skating aid resting in a storage position on a second bottom surface.
Figure 11:
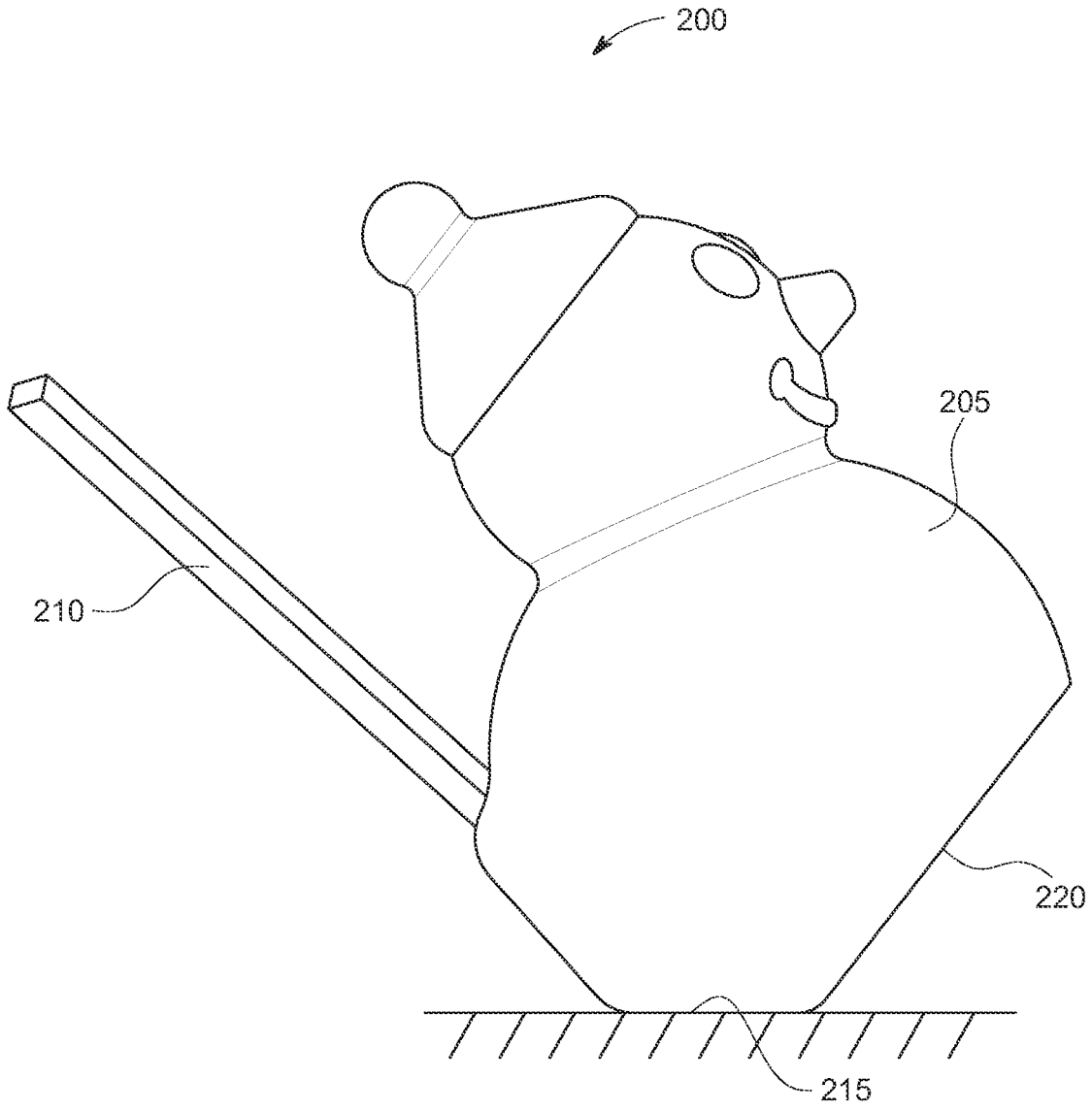
FIG. 11 is a perspective view of the fourth embodiment skating aid in a skating position with the aid being supported on a first bottom surface.

When tilted into a skating position with the aid resting on the ice on the first flat bottom section 215 as shown in FIG. 11, a skater can hold the handle and use the aid for support much in the same manner that the first embodiment is utilized. Additionally, when not in use the aid can be put into a storage position wherein the aid rests on the second flat bottom surface 220 and the handle extends substantially upwardly or slightly canted forwardly as best shown in FIG. 10.

The body 205 can be made of any suitable construction and take on any desirable form. In the illustrated embodiment the body is in the form of a snowman but the snow man is merely illustrative and not limiting. Because the users of the skating aid are typically children, having the aids resemble any of a number of novelty figures potentially enhances the the child's experience while learning to ice skate. Some of the possible figures represented by the body include but are by no means limited to penguins, Santa Claus, elves, turkeys, rabbits, dogs, cats, friendly small dinosaurs, and Disney and other well known cartoon characters.

Figure 12:
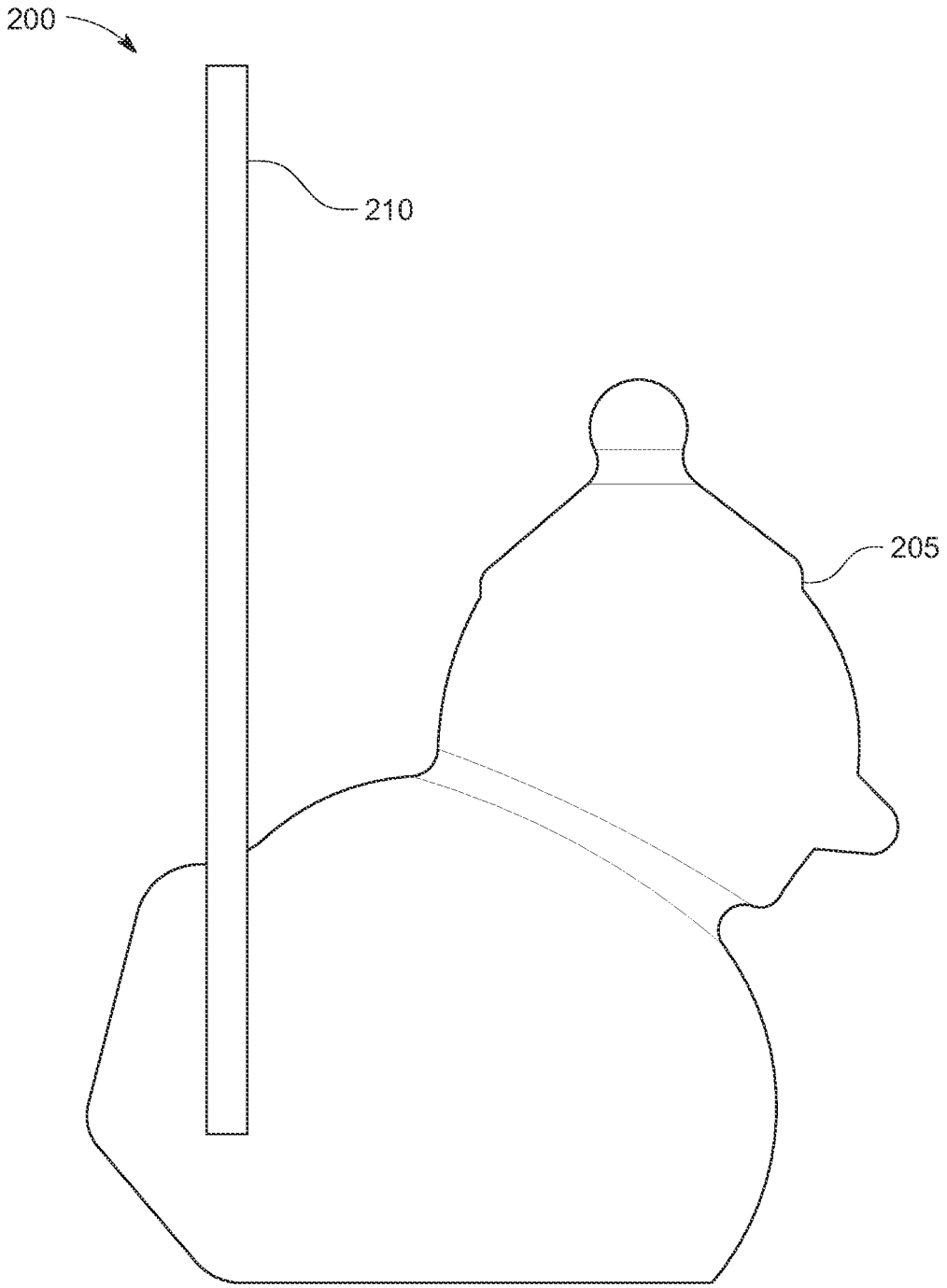
FIG. 12 is a cross sectional view of the fourth embodiment skating aid resting in the storage position on a second bottom surface.

Depending on the variation of the aid, the body 205 can be primarily made of a foam material as illustrated in the cross section of FIG. 12. Types of foam that can be used include both open and closed cell foams that are relatively forgiving if a skater accidentally falls into them. Some of the polymeric materials that can be used for the foam include Ethylene-vinyl acetate, polyethylene, polypropylene and polyurethane. In some variations the body is made entirely of foam, such as shown in FIG. 11.

Figure 13:
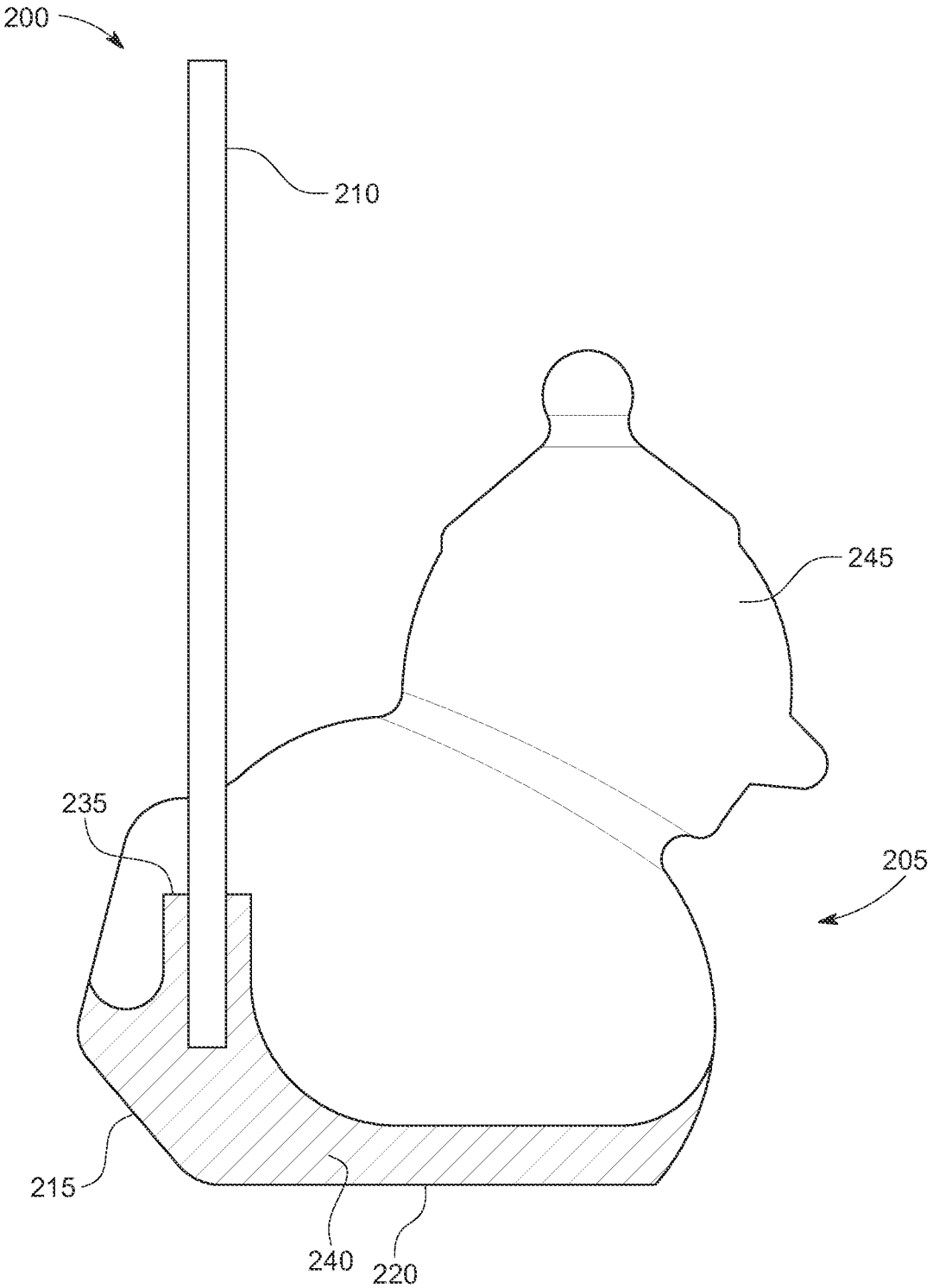
FIG. 13 is a cross sectional view of a variation of the fourth embodiment skating aid having a two part body structure with the aid resting in the storage position on a second bottom surface.

In another variation as shown in FIG. 13 most of the body's volume comprises a hollow top portion shell 245 having a thin forgiving plastic wall. This variation includes a base 240 made of a denser material, typically plastic or an elastomer, that includes a sleeve 235 for attaching the handle and the first and second flat bottom sections. For instance, where the sleeve and base comprise an elastomer, the sleeve may bend and deform if fallen upon to prevent or minimize injury to the falling person. A smooth low friction surface is typically provided on the first and second flat bottom sections acts to facilitate easier sliding on ice. The base can be of a standardized configuration and be designed to securely receive different shells thereon permitting the shell to be replaced if damaged or if an proprietor of the aid wants to install a different novelty character thereon.

In yet another variation, generally similar to the variation of FIG. 13, the top portion shell 245 can be replaced with a top portion comprising a lightweight and resilient foam material not dissimilar to the type of foam utilized in the variation shown in FIG. 12. Similarly, in this variation, the foam top portion can be removed from the base 240 and replaced as necessary or desired.

Figure 14:
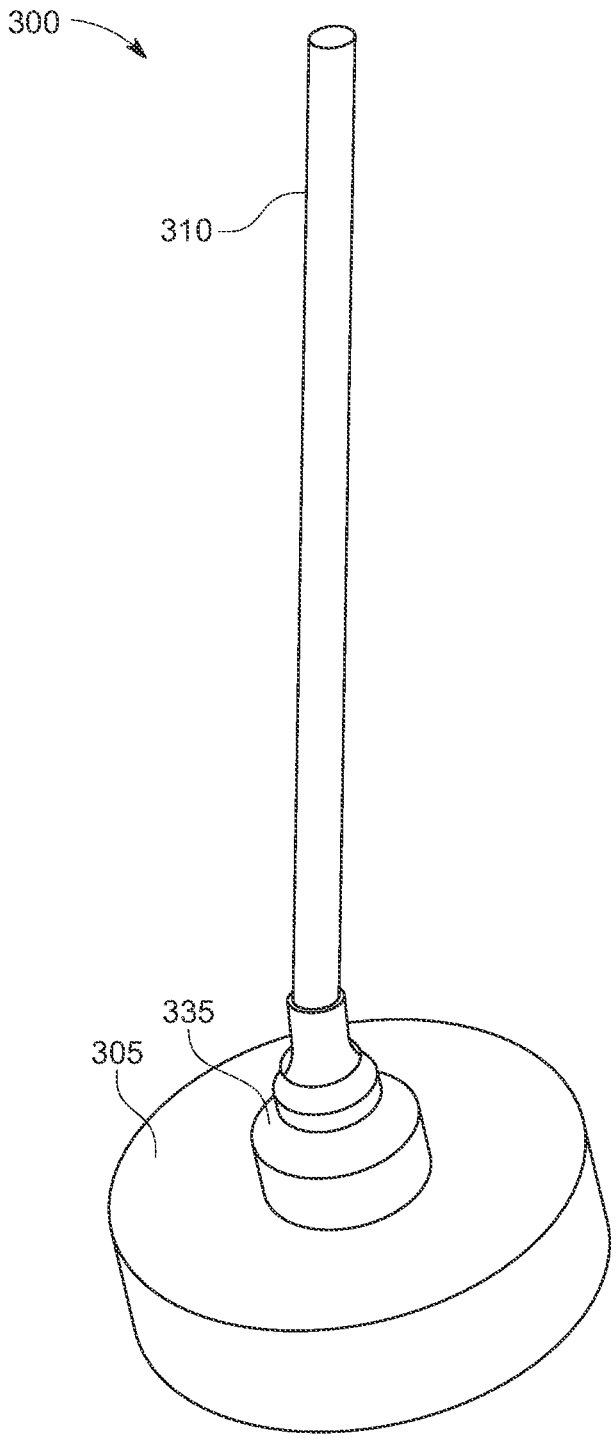
FIG. 14 is a perspective view of a fifth embodiment skating aid having a puck-like base and a elongated handle extending upwardly therefrom and being flexibly attached thereto.

A Fifth Embodiment Skating Aid Comprising a Puck-shaped Base With a Handle Extending From and Flexibly Coupled to its Center As illustrated in FIG. 14, the fifth embodiment skating aid 300 and its variations comprise a puck-like base 305 generally similar in size and exterior dimensions to the puck of the first, second and third embodiments, At a center point of the round puck a flexible connector 335 is provided to which an elongated handle 310 can be attached. As illustrated the connector comprises an elastomeric sleeve comprising one or more bellows that permit it the sleeve to be flexed and pulled downwardly and radially outwardly from any location around the base making it very convenient for a skater to use. When skating the user holds the handle at an angle relative to the base and surface of the underlying ice and pushes the base in front of him or her. When done skating the user releases the handle and it pops back to the vertical position allowing it to be compactly stored off to the side of the rink without the handle protruding potentially into the path of another skater.

The puck base can be made of any suitable material or combination of materials and may be hollow or solid. In one variation the puck can comprise a hard rubber or elastomer with a smooth bottom to facilitate its ability to slide across the ice. In some variations the base can be weighted to help keep the bottom firmly planted on the ice as the handle is pulled downwardly.

As mentioned and illustrated the connector 335 can comprise a flexible bellowed sleeve into which the handle is inserted and secured. The connector is also suitably secured to the puck base. The bellowed sleeve is stiff enough to support the handle in the vertical orientation when not being used but not so great as it is difficult to hold the stick in the extended position when in use. The handle is typically held in the sleeve through friction but may also be mechanically or adhesively secured as well.

In variations, other types of connectors can be utilized as a flexible angular coupling comprising a coil spring or a biased hinge coupling that permits the handle to be lowered in at least one direction. In yet other variations, the connector is not biased and may include a means, such as a screw or a positive positioning indexing mechanism to hold the handle in a desired position and angle.

A Sixth Embodiment Skating Aid Comprising a Puck-shaped Base Comprising a Foam and Having a Slot into which A Hockey Stick Blade Can Be Received.

Figure 15:
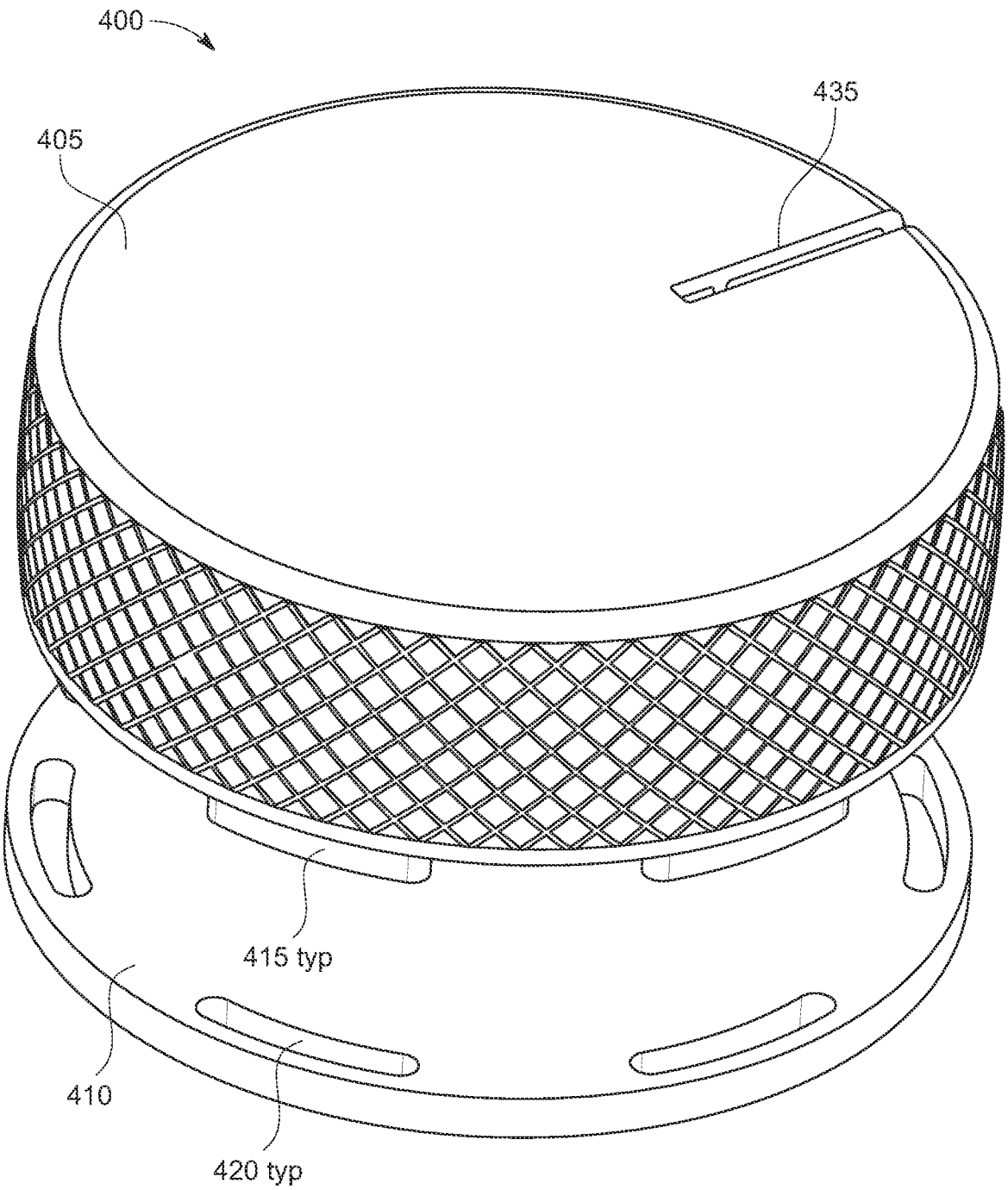
FIG. 15 is a perspective exploded view of a sixth embodiment skating aid comprising a puck-shaped blade cover with a top portion made primarily of a foam material with a slot and slot segments provided to receive the blade of a hockey stick therein and a bottom portion configured to interface with the surface of a skating rink.
Figure 16:
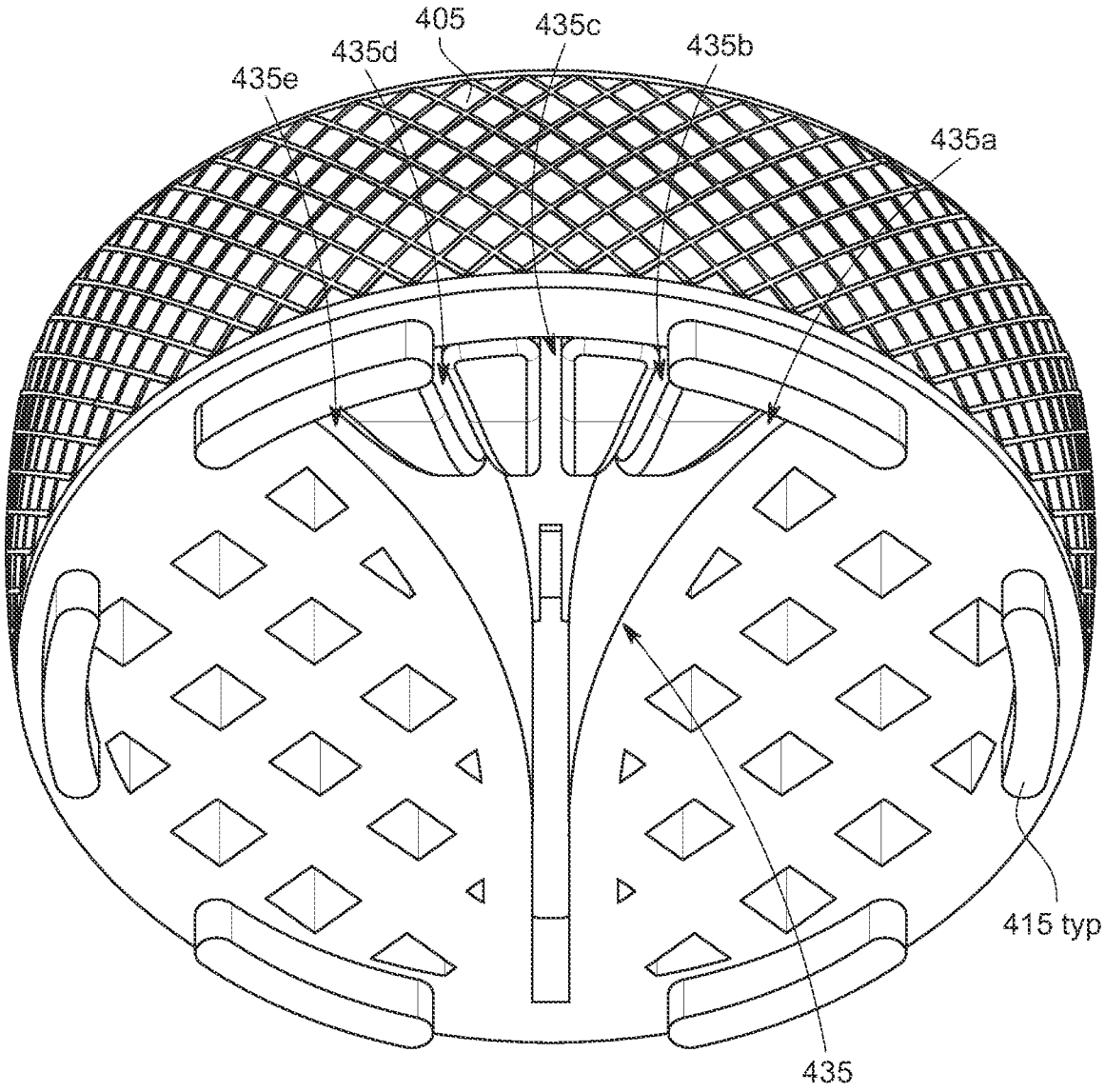
FIG. 16 is a bottom perspective view of the foam top portion of the sixth embodiment showing the slot segments.

Like the first, second and third embodiments, the sixth embodiment skating aid 400 as shown in FIGS. 15 & 16 is configured to receive and secure the blade of a hockey stick therein. Unlike the other embodiments, this embodiment comprises a top portion 405 that is substantially comprised of a foam material. In at least one variation, the foam material is a polyurethane foam that self-skins when formed in a mold. As shown in the exploded view of FIG. 15, the skating aid includes a slick base 410, such as polyethylene, nylon or a hard rubber, can be secured to the bottom to help facilitate sliding on an ice rink. As illustrated a plurality of slots 420 are provided around the perimeter of the base (or bottom portion) into which a corresponding plurality of tabs of the top portion 405 are received to secure the top and bottom portions together.

Most notably, a furcated slot 435 is molded into the puck-shaped base. It includes various tine or fingers 435*a-e* that can receive hockey stick blades having different curves therein. The blade of a hockey stick can be slid into the slot 435 from the top and side of the top portion and pushed into a suitable slot finger 435*a-e*. The blade is held securely in place by way of friction and compressive forces against the sides of the blade be the sides of the slot. Once a hockey stick is received therein, the combination can be utilized in the same fashion as the first, second and third embodiments. As can be appreciated, the dimensions and weight of the base are preferably configured such that the stick remains canted and upright when a user releases the stick's handle, although in other variations this may not necessary be the case.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, the construction of the second embodiment skating aid can vary substantially. The figures or novelty characters can vary. The snowman shown in the Figures is merely illustrative.

I claim:

1. A method of storing a skating aid when not in use, the method comprising:

providing the skating aid, the skating aid comprising (i) a body in the form of a novelty figure having at least a first flat bottom and a second flat bottom with each being selectively configured to rest on an underlying horizontal ice surface, the second flat bottom forming an angle of about 130-140 degrees relative to the first flat bottom, and (ii) an elongated handle with a handle axis, the handle axis extending outwardly and upwardly from the body at an angle of approximately 40 to 50 degrees relative to the first flat bottom and extending generally orthogonally relative to the second bottom, whereby the skating aid is in a use position to assist a skater in skating when the first flat bottom is positioned against the underlying horizontal ice surface, and in a storage position when the second flat bottom is positioned against the underlying horizontal ice surface; and placing the second flat bottom on the underlying horizontal ice surface.

2. The method claim 1, wherein the novelty figure comprises at least one of an animal, a dinosaur, Santa Claus, an elf, a snowman, and a cartoon character.

3. A method of skating using a skating aid, the method comprising:

providing the skating aid, the skating aid comprising (i) a body in the form of a novelty figure having at least a first flat bottom and a second flat bottom with each being selectively configured to rest on an underlying horizontal ice surface, the second flat bottom forming an angle of about 130-140 degrees relative to the first flat bottom, and (ii) an elongated handle with a handle axis, the handle axis extending outwardly and upwardly from the body at an angle of approximately 40 to 50 degrees relative to the first flat bottom and extending generally orthogonally relative to the second bottom, whereby the skating aid is in a use position to assist a skater in skating when the first flat bottom is positioned against the ice, and in a storage position when the second flat bottom is positioned against the ice; and tilting the skating aid off of the second bottom until the first bottom is substantially in contact with the underlying horizontal ice surface;

holding the handle in at least one hand; and skating on the underlying horizontal ice surface pushing the skating aid in front.

4. The method of claim 3, further comprising placing the second flat bottom on the underlying horizontal ice surface in the storage position.

5. The method claim 3, wherein the novelty figure comprises at least one of an animal, a dinosaur, Santa Claus, an elf, a snowman, and a cartoon character.

* * * * *